US005675320A

United States Patent [19]

Cecic et al.

[11] Patent Number: 5,675,320

[45] Date of Patent: Oct. 7, 1997

[54] GLASS BREAK DETECTOR

[75] Inventors: Dennis Cecic; Hartwell Fong, both of Scarborough, Canada

[73] Assignee: Digital Security Controls Ltd., Downsview, Canada

[21] Appl. No.: 522,716

[22] Filed: Sep. 1, 1995

Related U.S. Application Data

[63] Continuation-in-part of PCT/CA95/00122, Mar. 3, 1995.

[51] Int. Cl.[6] ..... G08B 13/00

[52] U.S. Cl. ..... 340/566; 364/728.07

[58] Field of Search ..... 340/566, 541; 364/728.07

[56] References Cited

U.S. PATENT DOCUMENTS

| | | | |
|---|---|---|---|
| 4,952,931 | 8/1990 | Serageldin et al. | 340/902 |
| 5,504,473 | 4/1996 | Cecic et al. | 340/541 |
| 5,510,765 | 4/1996 | Madau | 340/541 |
| 5,510,767 | 4/1996 | Smith | 340/566 |

*Primary Examiner*—Thomas Mullen

[57] ABSTRACT

The glass break detector uses sampling techniques and statistical analysis of the acoustic signal to determine whether a random type signal typical of a glass break event has been detected. A host of experiments are analysed and the collective results investigated to minimize the effect of one time non-typical occurrences in the signal. The statistical results are preferably used in combination with other techniques for identifying glass break events.

15 Claims, 4 Drawing Sheets

GLASS BREAK DETECTOR

CROSS-REFERENCE TO RELATED APPLICATIONS

This application is a continuation-in-part of PCT application Ser. No. PCT/CA95/00122, filed Mar. 3, 1995, claiming a priority date of Mar. 4, 1994, which application designated the United States.

FIELD OF THE INVENTION

The present invention relates to glass break detectors for identifying a glass break event. The invention is also directed to a method of detecting the shattering of glass.

BACKGROUND OF THE INVENTION

There are a number of existing glass break detectors which use a microphone to pick up the sound energy in a monitored space and process the signal to determine if a glass break event has occurred. A glass break event includes an initial signal portion commonly referred to as a "thud", which is associated with the initial force which led to the initial flexure of the glass, followed by the formation and propagation of cracks in the glass, followed by the catastrophic destruction of the glass. After this initial portion, the glass fragments continue to resonate and strike other glass fragments as they hit the floor and surroundings. This later portion is often referred to as the secondary effect or the tinkle portion.

Some glass break detectors detect an initial large amplitude component (i.e. the "thud") and then look for a further portion in the signal having many high frequency components. These high frequency components would tend to indicate the shattering of glass. Other detectors have additionally looked at the decay of the signal, which is also useful as an input in identifying a glass break event.

Prior art detectors continue to have problems in distinguishing glass break events from non-glass break events. Common false alarms are caused by thunder, dropping metal objects, ringing of bells, service station bells, chirping birds, slamming doors, splintering wood and mouse traps. These sound sources typically have both low frequency components and high frequency components as would a glass break event. It can be recognized that many of these sounds are periodic in nature.

The detection arrangement, according to the present invention, provides improved accuracy in predicting that a glass break event has occurred and has reduced problems with respect to false alarms. The occurrence of false alarms is a major problem for the security industry. According to one embodiment, the detector uses a microprocessor for processing the signal.

SUMMARY OF THE INVENTION

A glass break detector, according to the present invention, comprises an acoustic transducer which produces a wide band electrical signal in response to receipt of sound energy of a glass break event. The detector includes a processing arrangement for analysing the electrical signal of the acoustic transducer for possible detection of glass break events. The processing arrangement includes means for detecting a sudden high amplitude transient event that could be caused by the initial portion of a glass break event, waiting a short period of time after the detection of the sudden high amplitude transient event, and thereafter processing the signal over a further period of time, which period of time would include the high frequency random portion of a glass break event. The signal is processed by dividing the signal into many short experiments and analysing each experiment for an assessment of the degree of randomness in the experiment. The results of the experiments are statistically analysed to distinguish periodic signals from glass break signals which are random. The detector, upon recognition of a glass break signal, produces an alarm signal.

According to an aspect of the invention, the glass break detector includes a microprocessor as part of the processing arrangement which encodes the electrical signal into bits during sampling and for each experiment, compares each bit to the following bit and records any change in bit value as an assessment of the degree of change, and accumulates the number of changes for each sample.

According to yet a further aspect of the invention, the microprocessor uses an exclusive OR function for evaluating changes between bits of an experiment.

According to yet a further aspect of the invention, the microprocessor analyses the results of the experiments with respect to the distribution of the results of the experiments and based on at least two characteristics of the distribution, makes a prediction if a glass break event has been detected.

According to an aspect of the invention, a glass break detector includes means for detecting a sudden transient event which could be a glass break event, means for sampling the signal after a specified delay to form successive experiment segments where each experiment segment is of a sufficient time duration and sufficient sample points to include the random nature of a glass break signal when a sudden transient event has been detected, means for collecting and evaluating the results of the experiment segments using statistical techniques for characteristics which distinguish periodic signal sources from glass break event signals which are not periodic in nature, and means for producing an alarm when the means for evaluating indicates that the signal is not periodic.

According to an aspect of the invention, the glass break detector has a specified time delay which is sufficient to allow bodies which have been struck and thus producing a sudden transient large amplitude signal to resonate prior to sampling of the signal.

According to yet a further aspect of the invention, the statistical techniques include comparison of past values of the signal to future values of the signal.

According to yet a further aspect of the invention, the statistical techniques include autocorrelation.

A method of detecting the breaking of glass, according to the present invention, comprises using a microphone to detect sound in an area to be monitored, using an analog to digital converter to convert the signal from the microphone to a series of bits, analysing the series of bits over time to determine a measure of change in amplitude occurring in the signal in a first experiment, repeating the experiment many times, determining the distribution of changes in amplitude of the experiments and determining if the distribution is indicative of a possible glass break event by using the distribution to determine other statistical factors which assist in improving the prediction of whether a glass break event has occurred.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1A:
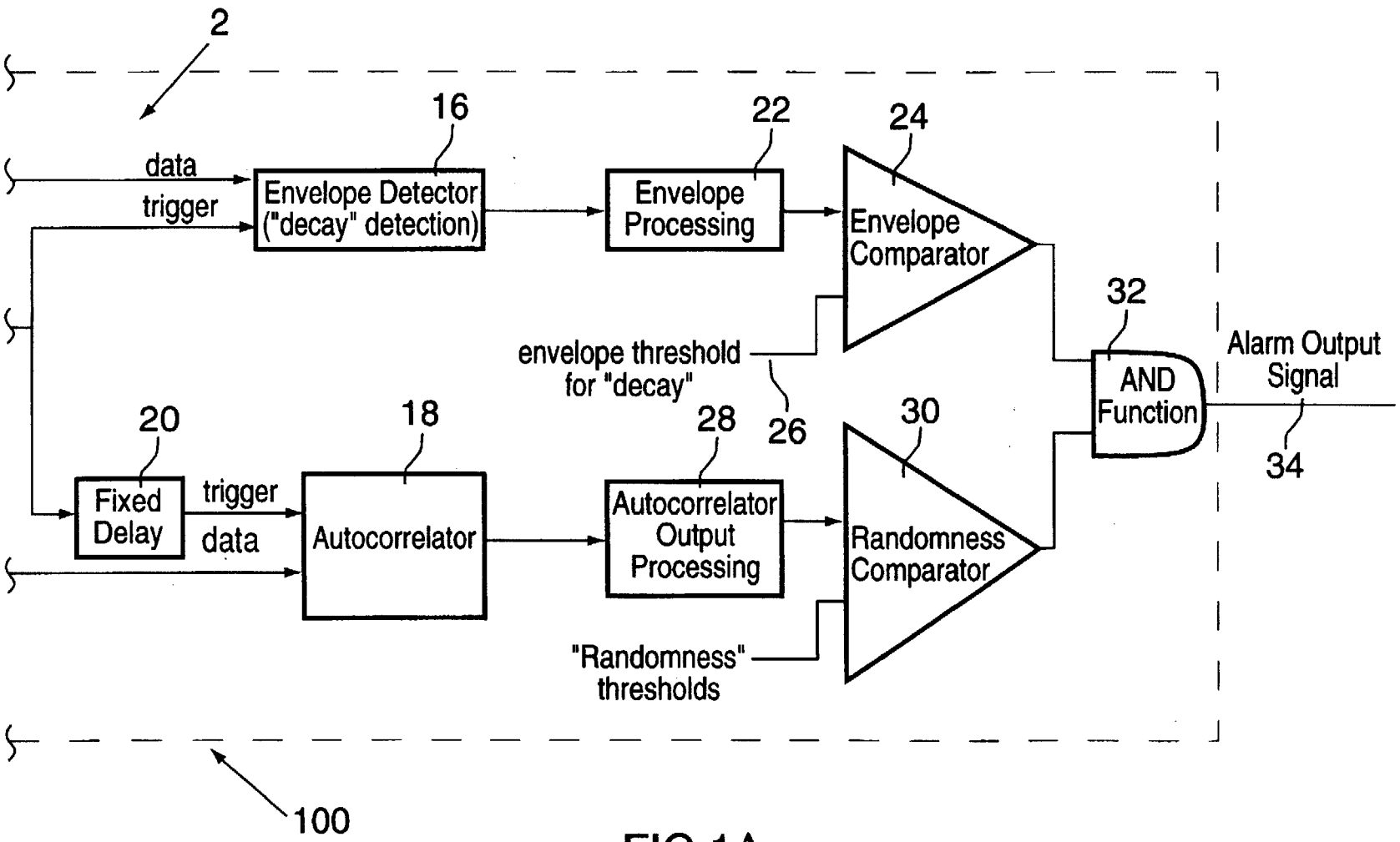
FIG. 1A illustrate a block diagram of the glass break detector.

An annealed glass break signal is shown in FIG. 1A. The signal has an initial "thud" portion followed by secondary effects, often referred to as the "tinkle" portion. The detector analyzes the "thud" portion for randomness and uses this analysis as an input in deciding whether a glass break event has occurred. This analysis is useful in detecting breaking of annealed glass, laminated glass, tempered glass and wired glass.

Figure 1B:
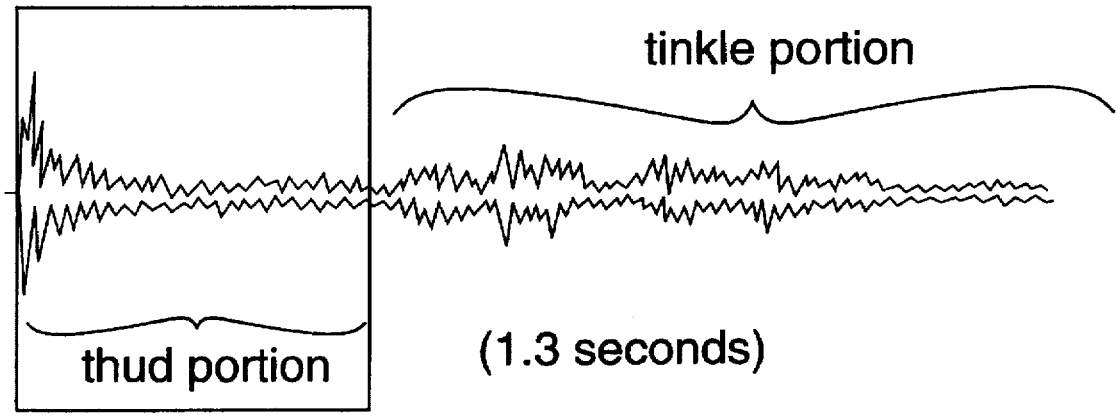
FIG. 1B shows a signal produced by an annealed glass break event.

The glass break detector 2 shown in FIG. 1 and 1A includes a microphone 4 which transforms sound energy into an electrical signal. This signal is passed through a band pass amplifier 6 and is converted to a digital signal by the 8 bit analog to digital converter 8. The digital signal is then fed to the envelope detector 10, which basically recognizes a sudden large amplitude transient signal. Once this initial portion of a glass break or other large signal is detected, it activates the envelope processing arrangement 12. The envelope of the signal is then compared to other envelopes to determine whether the envelope is similar to a glass break event signal. This envelope comparison is carried out by device 14. Given that an envelope 9 (see FIG. 2) has been detected which could have been produced by a glass break event, the signal is then fed to the envelope detector decay detection arrangement 16 and to the autocorrelator 18. The autocorrelator is only triggered after a fixed time delay introduced by the arrangement 20. This time delay is sufficient to allow struck bodies, which produce periodic signals, to resonate and thus produce a signal which is periodic in nature. It has been found that certain signals such as the start-up portion of a bell or the dropping of a wrench or other periodic signal sources, for a certain initial portion, may appear to be fairly random until the full effect of the resonance is established. Therefore, by introducing a time delay, the autocorrelator or other statistical analysis arrangement will be looking at the signal when it should be periodic if it is produced by a body which resonates. The typical delay is in the order of 50 to 100 milliseconds. The decay of the envelope is further processed by the arrangement 22 and the results of this processing are evaluated by the comparator 24 versus certain standards introduced at point 26. Given that the processing of the envelope has established that it could be a glass break event (large amplitude initial portion followed by exponential type decay) and given that the autocorrelator 18 has produced certain output processing results at 28, which meet the requirements for randomness established by the comparator 30, both these positive results are provided to the AND function at 32 and alarm output signal 34 will be created.

Full scale autocorrelation on an 8 bit signal is expensive and is difficult to carry out at high speeds. Processors are currently available to allow this to be carried out, however, the cost is quite high for the application of a consumer orientated glass break detector.

An alternative, lower cost approach for statistically analysing the signal and establishing whether or not the signal is periodic or random in nature has been developed which utilizes a microprocessor and the exclusive OR function of the microprocessor. The 8 bit signal for the evaluation of the signal for randomness is converted to a 1 bit signal using a digital comparator 21, and thus, is either 0 or 1. The amplitude threshold setting is above the normal circuit noise level, but is still relatively low to provide useful information in the last experiments being evaluated. This low level is possible as the analysis is initiated when a large amplitude signal (i.e. the "thud") is detected. With this arrangement, processing of the signal is carried out when there is a high signal to noise ratio.

A large signal evaluation portion, in the order of about 100 milliseconds, is studied to determine whether the signal source is periodic or random in nature. This study involves breaking the signal evaluation portion into many experiments, preferably about 30 experiments, such that each experiment is of a period of at least about 3 milliseconds or more. This time duration is sufficient to produce results, which when combined with the results of the other experiments, allows an accurate prediction of whether the signal source has a high periodic component. The 30 experiments provide improved reliability, as the results of each experiment will be tabulated and the collective results of the experiments will be used to predict whether or not the signal is a glass break event signal. The microprocessor can quickly evaluate each short time duration by performing an analysis to determine any transitions between 0 and 1. The sampling frequency is quite high and preferably produces 128 data points for each experiment. A number of transitions from 0 to 1 are tabulated by entering the number of transitions of an experiment in a histogram. By using all 30 experiments, a complete histogram of the distribution of the transitions is established for the larger time period in which the signal is evaluated. It has been found that the resulting distribution has a relatively precise modal value, a well defined range and a well defined modal area. If the measured distribution meets these requirements, it can be reasonably predicted that the signal is random in nature. The typical signals which cause false alarms are typically lower frequency signals and thus, have distributions of transitions which fall below these requirements. Some very high frequency period signals can produce a high number of transitions, but again, it is outside the range that it has been found common for random glass break signals. Some periodic signals could be of a frequency to produce the right number of transitions, but few common occurrence sounds having these characteristics have been found to date. In any event, there is substantial improvement as many periodic signals are distinguished.

Figure 2:
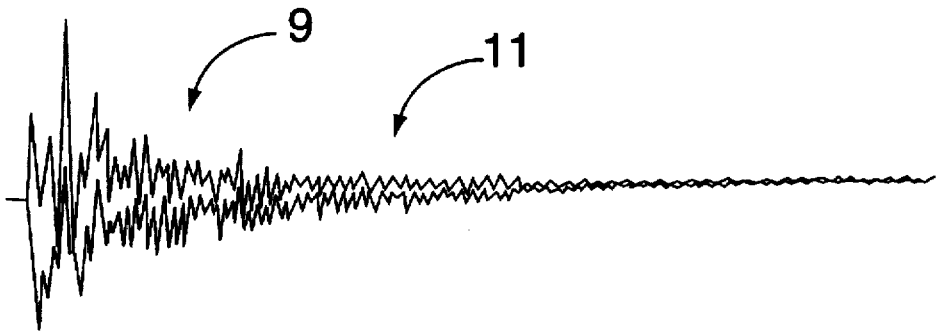
FIG. 2 shows a signal produced by a laminated glass break event.
Figure 3:
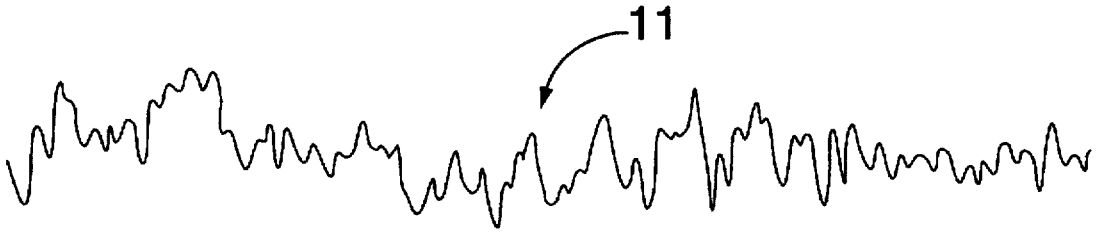
FIG. 3 shows an enlargement of the highlighted portion of the signal shown in FIG. 2.
Figure 4:
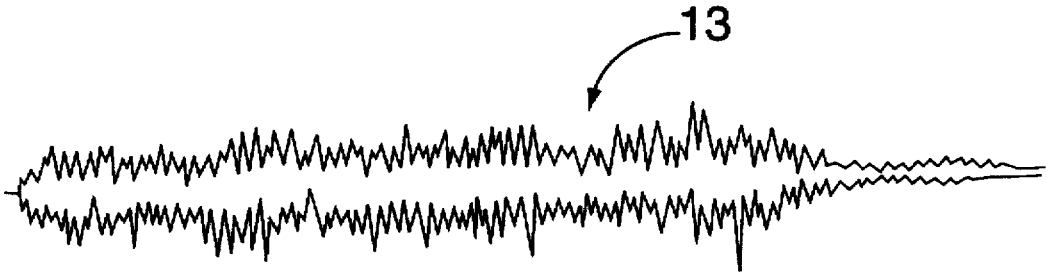
FIG. 4 shows a signal produced by an old style telephone ring.
Figure 5:
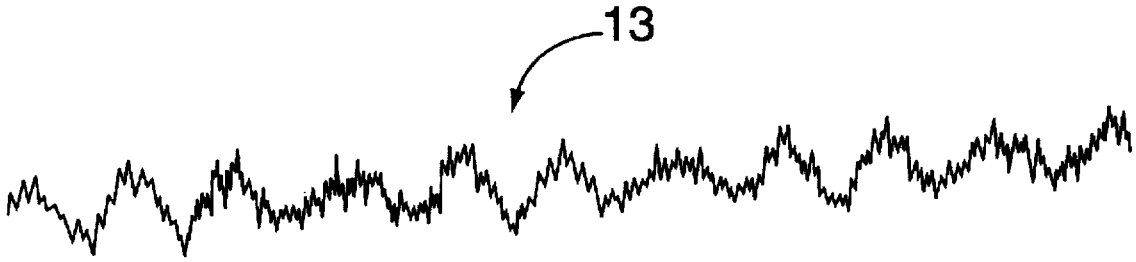
FIG. 5 shows an enlargement of the highlighted portion of FIG. 4.
Figure 6:
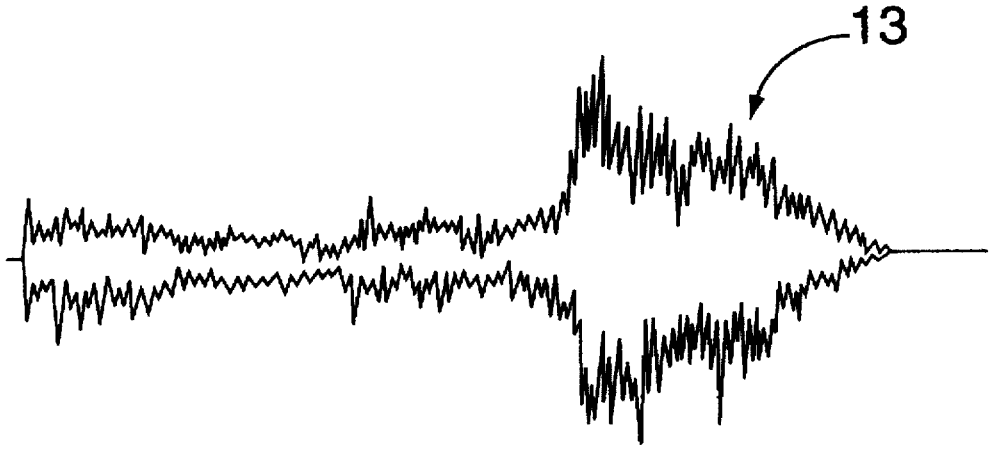
FIG. 6 shows a signal produced by a dropped wrench with FIG. 7 showing an enlargement of the highlighted portion.
Figure 7:
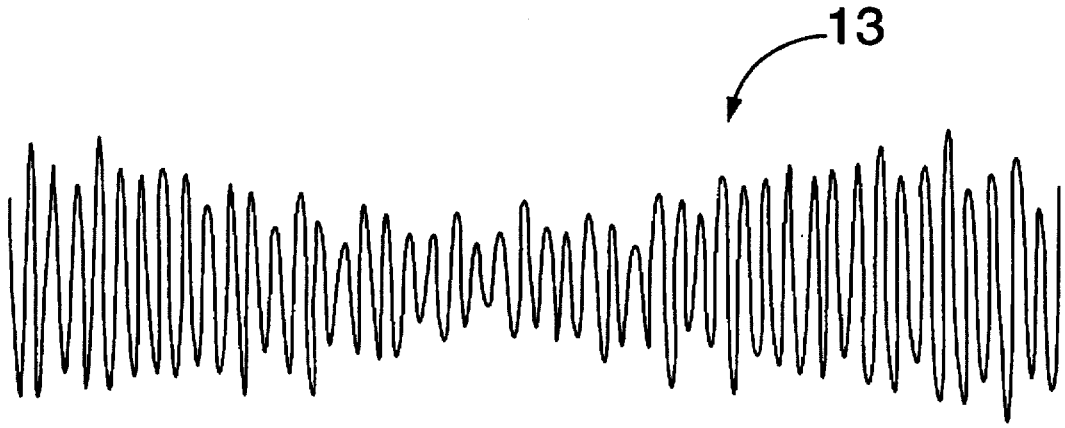

The present invention recognizes that in a glass break signal, past values of the signal are not related to future values of the signal, and thus, an autocorrelation technique or a technique which evaluates the relationship of past values to future values is useful in distinguishing periodic signals from the signal produced during a glass break event. Furthermore, the present invention recognizes that by conducting a large number of experiments, in the example approximately 30 experiments, and tabulating the results of each experiment and then analysing the distribution of the results of the collective experiments greatly improves the confidence in predicting whether a glass break signal has been detected and minimizes the effect of one time anomaly conditions in the signal. The signal 11 produced by breaking glass, as shown in FIGS. 2 and 3 is random in nature, whereas the signal 13 of FIGS. 4 through 7 is periodic in nature.

The detector has to function in a host of different environments and will have environments with different background noises and thus, it cannot be assumed that the glass break event signal will produce the same result. The fact that the glass break event signals are random essentially means that each glass break signal will be unique. The uniqueness of each glass break signal can be quantified by evaluating all of the experiments and then looking at the distribution of the results, as discussed above. Although the actual results are different and the order of them may be different, the cumulative effect of the results are well defined and the characteristics of the distribution of the results can be used to determine whether the signal being evaluated is random and typical of a glass break event signal. This analysis, when combined with detection of the "thud" and envelope evaluation, has proven very effective.

The present invention teaches a particular technique and low cost application for glass break detectors. The system works with improved accuracy using a digital signal processor and carrying out a traditional autocorrelation analysis. It can be appreciated that the processing of the glass break signal loses information along the way. For example, the microphone will not have an equal response for all frequencies, and thus, introduces the first compromise in the signal to be analysed. The conversion of the signal to an 8 bit signal followed by conversion to a 1 bit signal removes a great deal of information, however, it does allow the microprocessor 100 to process the information quickly in real time and make a fast prediction of whether a glass break event has occurred. As the applications for digital signal processors increase, the cost for this type of processor will become more favorable and it will then be possible to use more conventional statistical techniques which do not remove as much data and thus, can more accurately compare past values of the signal with future values of the signal such that the sampling and statistical techniques described above using full autocorrelation can more accurately predict glass break events.

To further understand the invention, consider evaluation of the following 128 8-bit integer numbers between 1 and 256 generated from a random source:

{56, 189, 122, 58, 224, 214, 33, 50, 101, 22, 229, 203, 161, 214, 188, 158, 70, 69, 162, 89, 175, 20, 217, 31, 171, 17, 114, 149, 220, 160, 213, 116, 137, 164, 95, 109, 224, 117, 140, 61, 41, 36, 223, 51, 125, 158, 49, 222, 206, 2, 70, 224, 75, 226, 76, 238, 58, 122, 131, 161, 200, 80, 229, 246, 211, 207, 243, 32, 194, 46, 131, 252, 160, 169, 251, 224, 162, 244, 138, 168, 32, 233, 77, 133, 183, 67, 139, 189, 80, 241, 79, 190, 61, 218, 242, 2, 197, 143, 113, 72, 16, 107, 47, 237, 74, 5, 172, 213, 249, 76, 48, 50, 51, 117, 55, 21, 208, 158, 79, 49, 27, 130, 40, 2, 167, 132, 29, 210}

And the following data set generated from a periodic source:

{128, 159, 188, 214, 234, 249, 255, 255, 246, 231, 209, 183, 153, 122, 91, 62, 37, 18, 6, 0, 2, 12, 29, 52, 79, 109, 141, 171, 199, 223, 241, 252, 256, 252, 241, 223, 199, 171, 141, 109, 79, 52, 29, 12, 2, 0, 6, 18, 37, 62, 91, 122, 153, 183, 209, 231, 246, 255, 255, 249, 234, 214, 188, 159, 128, 97, 68, 42, 22, 7, 1, 1, 10, 25, 47, 73, 103, 134, 165, 194, 219, 238, 250, 256, 254, 244, 227, 204, 177, 147, 115, 85, 57, 33, 15, 4, 0, 4, 15, 33, 57, 85, 115, 147, 177, 204, 227, 244, 254, 256, 250, 238, 219, 194, 165, 134, 103, 73, 47, 25, 10, 1, 1, 7, 22, 42, 68, 97, 128}

The autocorrelation function for discrete data is given as follows:

$$R_{xx}(j) = \frac{1}{N} \sum_{n=1}^{N} x(n)\, x(n+j)$$

Using the above equation for n=128 and j=1, the random signal produces autocorrelation result of 17241 and for the periodic signal autocorrelation result of 28480. Unfortunately, these results require extensive processing at a fast rate and an approximation is preferred to reduce cost and lower power consumption.

As discussed, the detector uses a microprocessor which analyses data which is converted or coded to 1 bit or 2 level amplitude resolution.

The converted data for the random data set using 128 as the comparator threshold level is as follows:

{0, 1, 0, 0, 1, 1, 0, 0, 0, 0, 1, 1, 1, 1, 1, 1, 0, 0, 1, 0, 1, 0, 1, 0, 1, 0, 0, 1, 1, 1, 1, 0, 1, 1, 0, 0, 1, 0, 1, 0, 0, 0, 1, 0, 0, 1, 0, 1, 1, 0, 0, 1, 0, 1, 0, 1, 0, 0, 1, 1, 1, 0, 1, 1, 1, 1, 0, 1, 0, 1, 1, 1, 1, 1, 1, 1, 1, 1, 0, 1, 0, 1, 1, 0, 1, 1, 0, 1, 0, 1, 0, 1, 1, 0, 1, 1, 0, 0, 0, 0, 0, 1, 0, 0, 1, 1, 1, 0, 0, 0, 0, 0, 0, 1, 1, 0, 0, 0, 1, 0, 0, 1, 1, 0, 1}and the resultant periodic data after conversion is:

{0, 1, 1, 1, 1, 1, 1, 1, 1, 1, 1, 1, 0, 0, 0, 0, 0, 0, 0, 0, 0, 0, 0, 0, 1, 1, 1, 1, 1, 1, 1, 1, 1, 1, 1, 1, 0, 0, 0, 0, 0, 0, 0, 0, 0, 0, 0, 0, 1, 1, 1, 1, 1, 1, 1, 1, 1, 1, 1, 1, 0, 0, 0, 0, 0, 0, 0, 0, 0, 0, 0, 0, 0, 0, 0, 0, 0, 0, 0, 0, 0, 0, 0, 0, 1, 1, 1, 1, 1, 1, 1, 1, 1, 1, 1, 1

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property of privilege is claimed are defined as follows:

1. A glass break detector for detecting the breaking of glass comprising an acoustic transducer which produces a wide band electrical signal in response to receipt of sound energy of a glass break event, a processing arrangement for analyzing the electrical signal of the acoustic transducer for detection of glass break events, said processing arrangement including means for detecting a sudden high amplitude transient event that could be caused by the initial portion of a glass break event, waiting a short period of time after detection of a sudden high amplitude transient event and thereafter sampling the signal over a further period of time which would include the high frequency glass shattering portion of a glass break event, said signal being sampled by dividing the signal into many short segments and analyzing each short segment for an assessment of the degree of randomness in the short segment, using the assessment of the short segments to distinguish periodic signals from glass break signals and upon recognition of a glass break signal producing an alarm signal.

2. A glass break detector as claimed in claim 1 wherein said processing arrangement includes a microprocessor which converts the electrical signal into bits during sampling and for each sample compares each bit to the following bit and records any change in the bit value as an assessment of the degree of change and accumulates the number of changes for each sample period.

3. A glass break detector as claimed in claim 2 wherein said microprocessor uses an exclusive OR function for evaluating changes between bits of a sample period.

4. A glass break detector as claimed in claim 3 wherein said microprocessor analyses the results of the samples with respect to distribution of the results and based on the characteristics of the distribution makes a prediction if a glass break event has been detected.

5. A glass break detector as claimed in claim 4 wherein the characteristics of the distribution include determination whether the modal value falls within a given range, an assessment of the range of the distribution and an assessment of the modal area.

6. A glass break detector as claimed in claim 2 wherein the signal from the acoustic transducer is converted to an 8 bit digital signal.

7. A glass break detector comprising means for detecting a sudden transient event which could be a glass break event and producing a signal derived from said transient event, means for sampling the signal after a specified delay to form successive experiment segments when a sudden transient event has been detected where each experiment segment comprises a series of many samples, means for evaluating the experiment segments using statistical techniques for characteristics which distinguish periodic signal sources from glass break event signals which are not periodic, and means for producing an alarm when said means for evaluating indicates the signal is not periodic.

8. A glass break detector as claimed in claim 7 wherein said specified delay is sufficient to allow bodies which have been struck thus producing a sudden transient signal to resonate.

9. A glass break detector as claimed in claim 7 wherein said statistical techniques include comparison of past values of the signal to future values of the signal.

10. A glass break detector as claimed in claim 9 wherein said statistical techniques include autocorrelation.

11. A glass break detector as claimed in claim 10 wherein autocorrelation is carried out on each experiment segment whereafter the distribution of the auto correlation results are compared.

12. A glass break detector as claimed in claim 9 wherein said specified delay is approximately 50 milliseconds and each experiment segment is of a duration of at least 2.5 milliseconds.

13. A glass break detector as claimed in claim 12 wherein about 30 experiment segments are analysed.

14. A method of detecting the breaking of glass comprising using a microphone to detect sound in an area to be monitored, using an analog to digital converter to convert the signal from the microphone to a series of bits, analysing the series of bits over time to determine a measure of change in amplitude occurring in the signal in a first experiment, repeating the experiment many times, determining the distribution of changes in amplitude of the experiments and determining if the distribution is indicative of a glass break event by using the distribution to determine other statistical factors which assist in distinguishing a glass break event from other transient events.

15. A method as claimed in claim 14 wherein said statistical factors include determining the mode, range and mean of the distribution.

* * * * *